US006729048B1

(12) United States Patent
Grandin et al.

(10) Patent No.: US 6,729,048 B1
(45) Date of Patent: May 4, 2004

(54) FOOTWEAR HAVING A SHELL OF INJECTION MOULDED PLASTIC

(75) Inventors: Giorgio Grandin, Trevignano (IT); Pierluigi Lorati, Ponte di Legno (IT); Sante Marinello, Volpago del Montello (IT)

(73) Assignee: Tecnica S.p.A., Montello (IT)

( * ) Notice: Subject to any disclaimer, the term of this patent is extended or adjusted under 35 U.S.C. 154(b) by 58 days.

(21) Appl. No.: 10/221,745

(22) PCT Filed: Nov. 10, 2000

(86) PCT No.: PCT/IT00/00452

§ 371 (c)(1),
(2), (4) Date: Sep. 16, 2002

(87) PCT Pub. No.: WO02/37994

PCT Pub. Date: May 16, 2002

(51) Int. Cl.[7] ..... A43B 5/04; A43B 23/00; A43C 11/00

(52) U.S. Cl. ..... 36/50.5; 36/50.1; 36/117.1; 36/136

(58) Field of Search ..... 36/50.5, 50.1, 36/117.1, 53, 54, 84, 132, 136

(56) References Cited

U.S. PATENT DOCUMENTS 3,657,827 A * 4/1972 Rieker ..... 36/50.1
4,372,061 A * 2/1983 Pozzobon ..... 36/50.5
4,974,346 A 12/1990 Marega et al.
5,491,910 A * 2/1996 Zorzi ..... 36/50.5
5,647,150 A 7/1997 Romanato et al.
5,649,375 A * 7/1997 Zorzi ..... 36/50.1

FOREIGN PATENT DOCUMENTS

EP 0583565 * 2/1994 ..... A43B/5/04
FR 2694167 A 2/1994

* cited by examiner

*Primary Examiner*—Anthony D. Stashick
(74) *Attorney, Agent, or Firm*—Birch, Stewart, Kolasch & Birch, LLP

(57) ABSTRACT

The upper part (3) of the shell (1), manufactured as one piece from polymer material, of a footwear is divided on the front into two pairs of flaps (6A, 7A; 6B, 7B) by a longitudinal separating line (5) and by a transverse slit provided opposite the user's heel. Two removable inserts (11, 12) are provided, which may even be manufactured using a type of polymer material different from that of the shell (1), have parts (13, 15; 14, 16) which are designed to interfere both with the outer surface and with the inner surface of the said flaps (6A, 7A; 6B, 7B) and also have interconnecting parts (17, 18) which are designed to be retained by the twfo sections (8A, 8B) of the transverse slit. USE: Ski boots and skating boots, safety footwear and the like. ADVANTAGES: No infiltration (e.g. of water and snow) into the boot; more efficient manufacturing of the boot.

6 Claims, 6 Drawing Sheets

FOOTWEAR HAVING A SHELL OF INJECTION MOULDED PLASTIC

This application is the national phase under 35 U.S.C. § 371 of PCT International Application No. PCT/IT00/00452 which has an International filing date of Nov. 10, 2000, which designated the United States of America.

The present invention relates to a footwear having a shell manufactured as one piece by means of injection moulding of polymer material. The present description refers to a downhill skiing boot, but it is understood that the invention also refers to other types of footwear, for example skating boots or working (safety) boots.

As is well-known, in a boot of this kind the shell comprises, as one piece, a rigid sole and two softer sidewalls which extend upwards above the user's heel. The boot is completed by other structural and functional components, in particular an outer leg-piece hinged on the sidewalls. So as to allow introduction of the foot, the shell is divided, above the sole, by longitudinal (vertical) separation lines into two flaps which overlap over a considerable length in the uppermost part of the boot.

For the dual purpose of facilitating introduction of the foot from above and adapting the internal surface of the shell to the instep of the said foot, the Applicant has for several years now already devised a shell having a slit which is transverse with respect to the longitudinal centre plane and is positioned opposite the user's heel so as to divide each of the two said flaps into two parts with the mutual possibility of a limited movement—see patent U.S. Pat. No. 4,974,346. In this way each flap of the upper remains attached to the corresponding flap of the leg-piece. In order to minimize the infiltration of snow or water into the boot, without exerting an excessive pressure on the user's foot, two tongues are used, said tongues being shaped so as to follow the curved form of the shell in the region of the slit The tongues are provided with transverse ribs which are as long as the slit and project as one piece towards the outside. In order to fix on an industrial scale the tongues inside the shell, more precisely either to the two flaps of the upper (i.e. underneath the slit) or to the two flaps of the leg-piece (i.e. above the slit), a heat-welding process is used.

In contrast to the considerable advantages greatly appreciated by the users, of the boots this solution involves for the boot manufacturer not insignificant technical drawbacks relating precisely to the heat-welding process for fixing the tongues:

- this process must be carried out on a special production line which is not timed with the other assembly steps of a boot;
- there is the risk of small cracks forming in the above mentioned shell flaps, which cracks with repeated use may grow bigger until the boot becomes unusable;
- it cannot be used with all types of polymer materials, in particular with polypropylene which would ensure good properties at a relatively low cost.

Cases have also occurred where, owing to poor adhesion of the tongues to the shell flaps following repeated use of the boot, a certain infiltration of snow or water inside the shell occurs, to the obvious disappointment of the user.

It will be desirable—and this in fact forms the main object of the invention—to provide a reliable boot which may guarantee satisfaction for the users and which does not give rise to the said drawbacks for the manufacturer.

A boot with the characteristic features claimed hereinbelow is able to achieve this and other objects, as will appear more clearly from the non-limiting description of the embodiment shown in the accompanying drawing in which:

Figure 1:
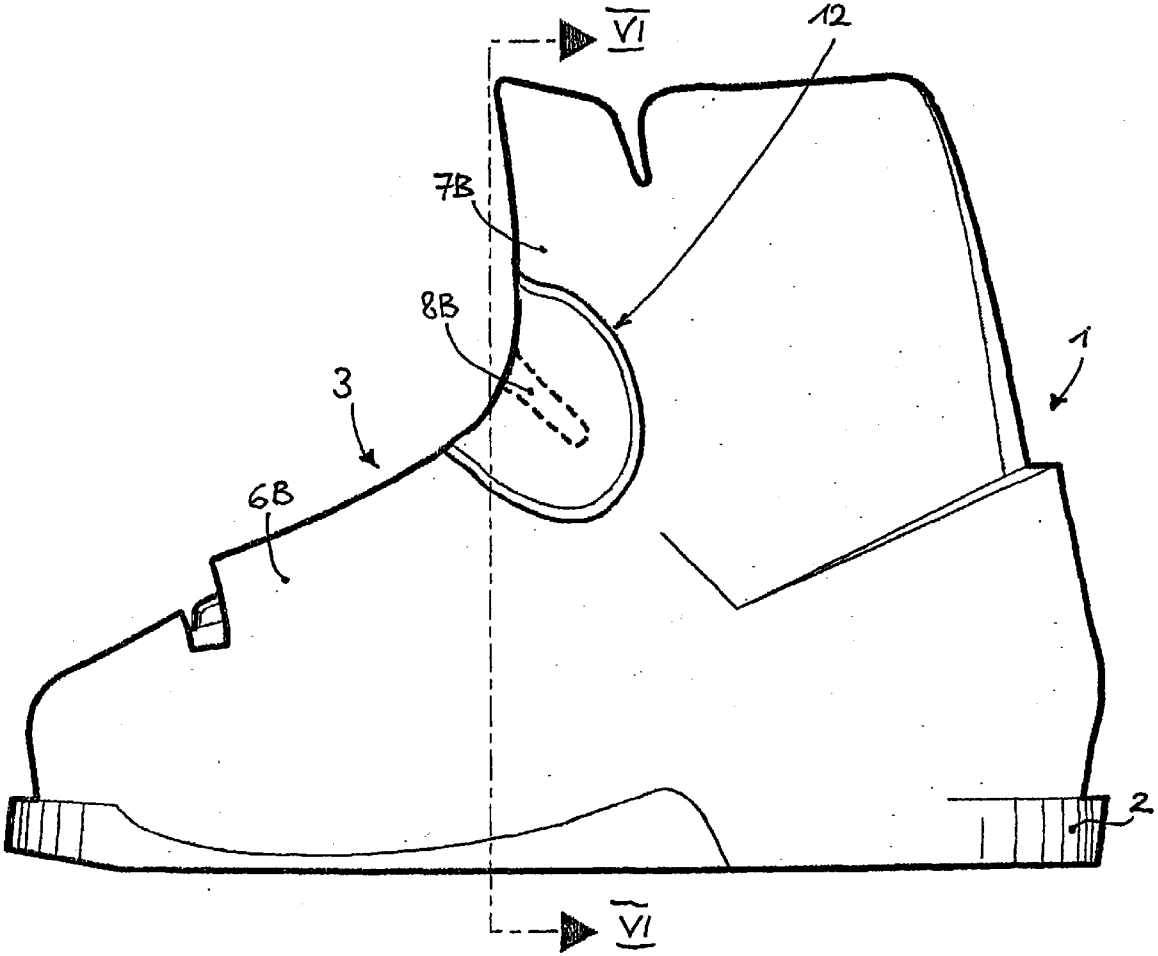
FIG. 1 is a schematic side view of a shell, as seen from the inner side of a ski boot according to the invention.
Figure 2:
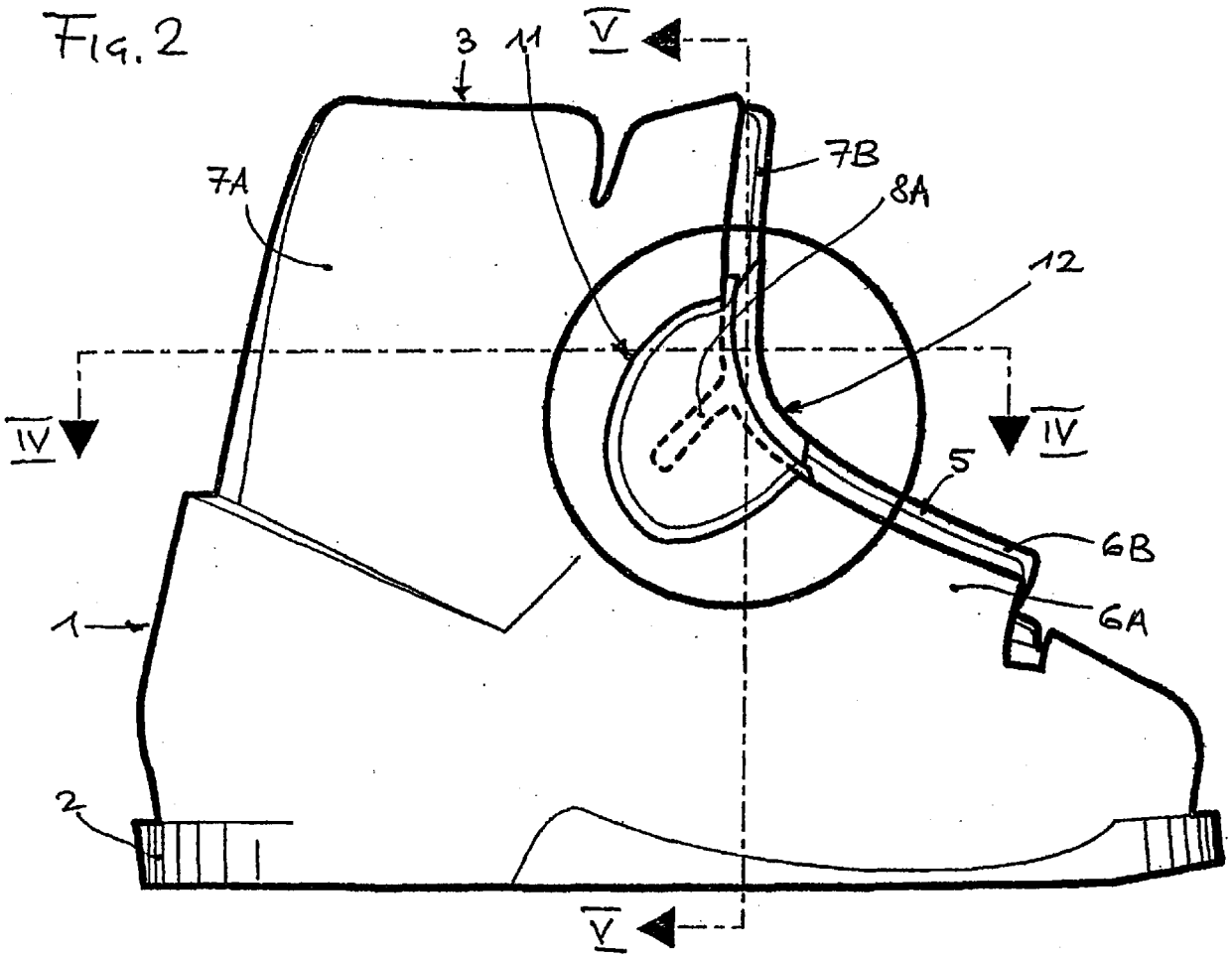
FIG. 2 is a schematic side view as seen from the outer side of the boot.
Figure 3:
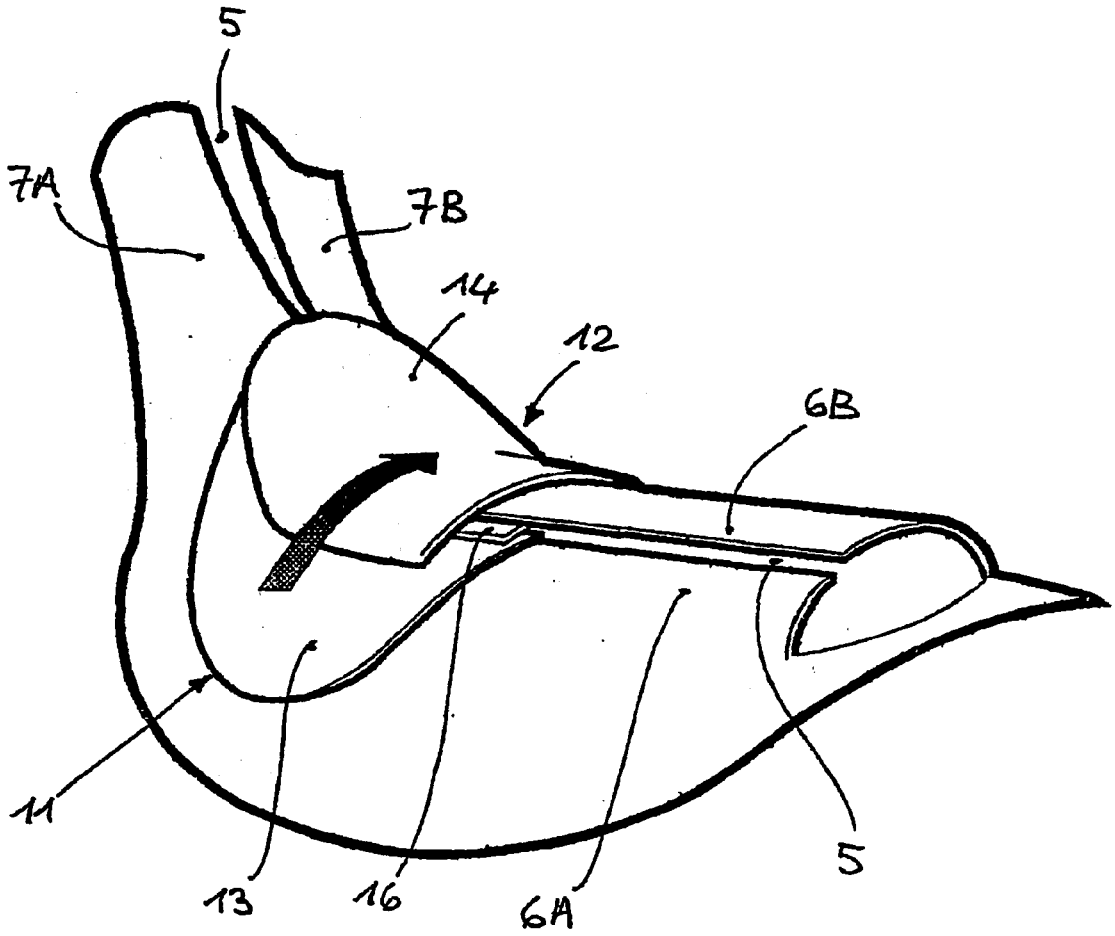
FIG. 3 shows a three-dimensional view, on a larger scale, of the details enclosed in a circle in FIG. 2.
Figure 4:
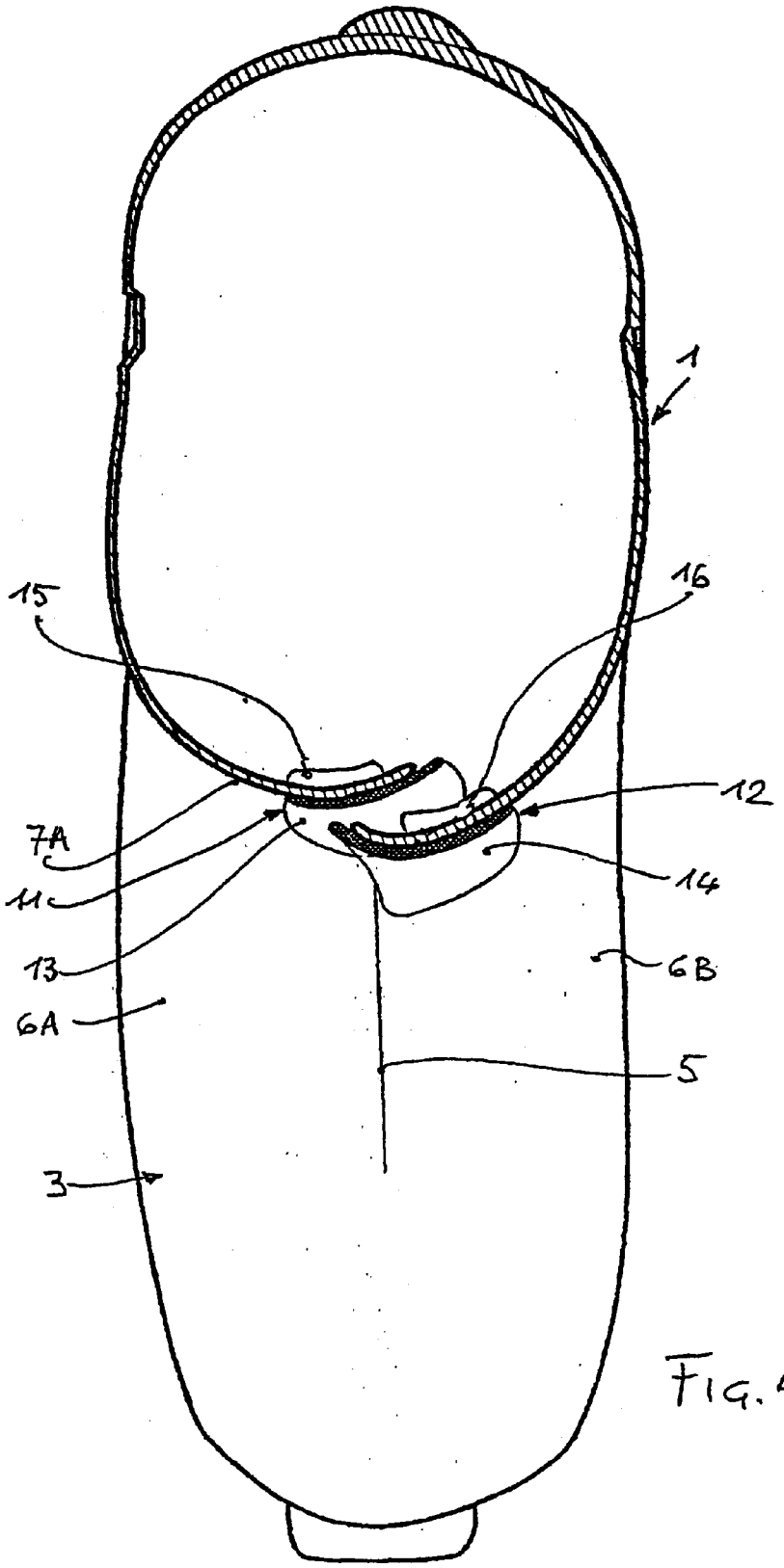
FIG. 4 is a schematic view, from above, of the said boot shell partially sectioned along the line IV—IV in FIG. 2.

With reference to FIGS. 1 to 4, the shell 1 of a ski boot, which is made of polymer material by means of injection moulding, consists of a rigid sole 2 and a less rigid upper part 3 which extends a certain distance above the user's heel. Both for the sake of simplicity and because they are not directly related to this invention, other major parts of the boot, such as the leg-piece, which is hinged on the upper part 3, and the inner shoe, which is manufactured separately using a particularly soft material, have not been shown.

On the front of the shell 1, a separating line 5, parallel to the longitudinal centre plane of the boot, divides the said upper part 3 into an inner part and an outer part As in the above mentioned patent U.S. Pat. No. 4,974,346 in the name of the same Applicant, the same upper part 3 of the shell 1 has, formed in it, a slit which, following the curvature thereof, extends transversely with respect to the separating line 5 opposite the user's heel. The said slit consists of a first section 8A which divides the said upper part 3 into a first pair of flaps 6A and 7A on the outer side of the shell 1 and a second section 8B which divides the said upper part 3 into a second pair of flaps 6B and 7B on the inner side. As can be seen in the Figures, the flaps 6A and 6B are situated in a lower position and are slightly inclined with respect to the horizontal, while the flaps 7A and 7B are located in a higher position and are approximately vertical. The slit ensures that the flaps 6A and 7A, as well as the flaps 6B and 7B, are joined together with the mutual possibility of a relative movement, so as to facilitate introduction of the foot into the boot.

According to the main characteristic feature of the invention, the infiltration of snow or water into the boot is prevented by a pair of removable inserts 11 and 12 which are designed to be joined to the said upper part 3 of the shell 1 so as to extend both above and below the said transverse slit, both on the inner side and on the outer side.

Figure 5:
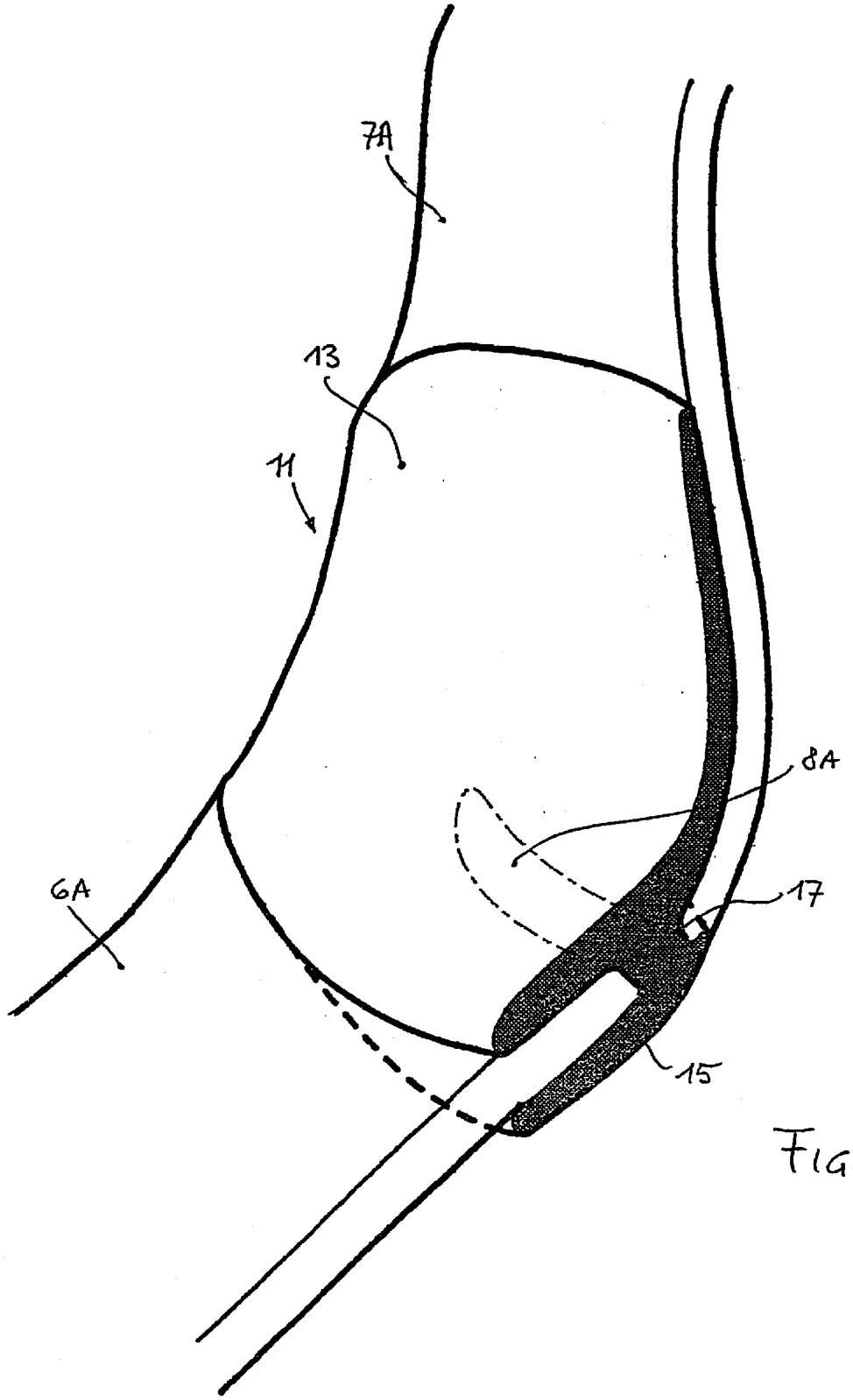
FIGS. 5 and 6 are partial vertical sections along the line V—V in FIG. 2 and the line VI—VI in FIG. 1, respectively.
Figure 6:
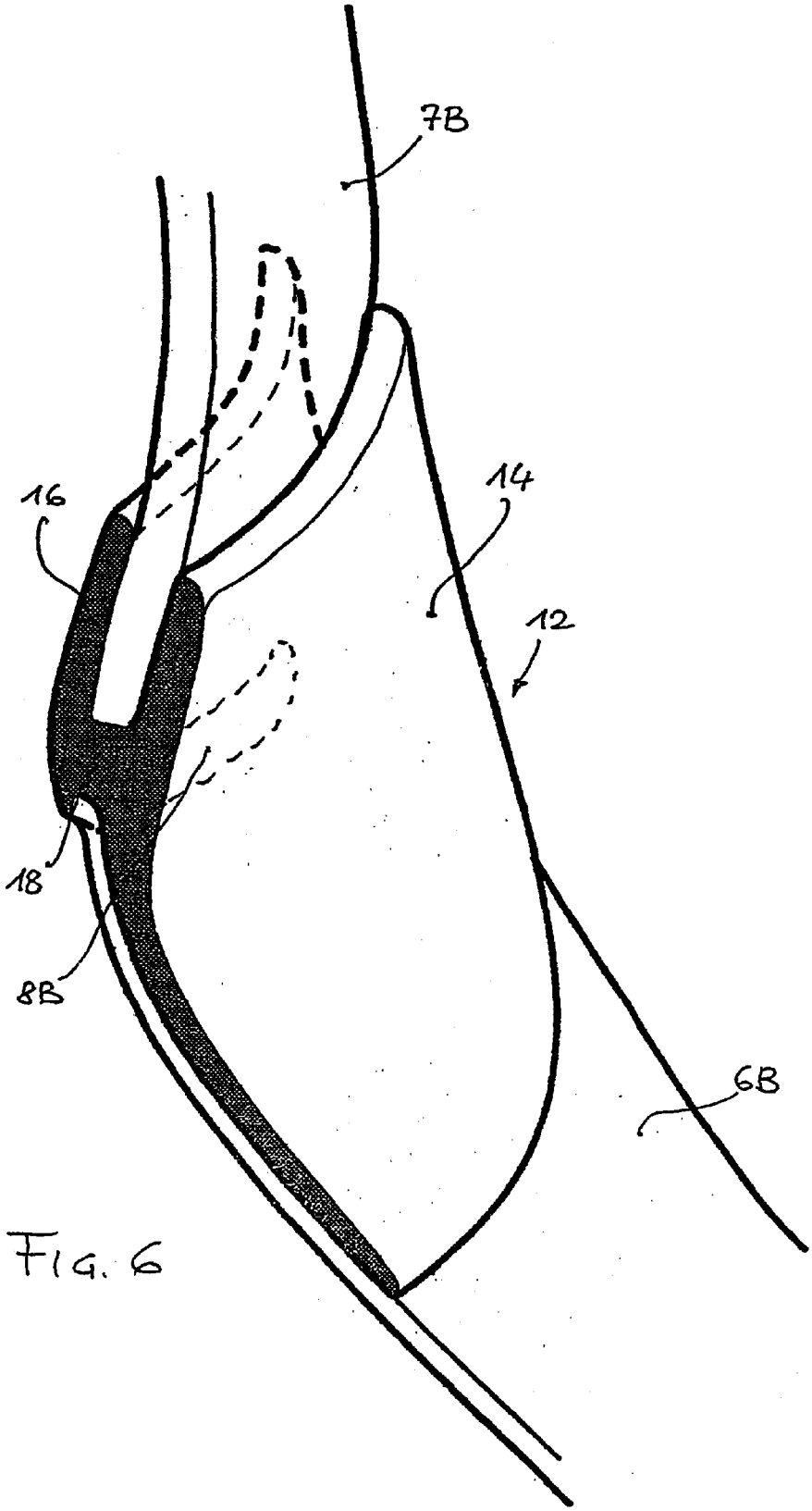

More precisely, the inserts 11 and 12 consist of a flange 13 and 14, respectively, of greater width and a flange 15 and 16, respectively, of smaller width, and an interconnecting part 17 and 18, respectively. Owing to the shape and dimensions of these parts, the inserts 11 and 12 follow the curvature of the shell 1 (and hence the curvature of the instep of the user's foot opposite the heel) both longitudinally and transversely—see FIG. 3. In fact, the flanges 13 and 15, 14 and 16 are designed to remain in close contact, respectively, with the flaps 6A, 7A and the flaps 6B, 7B (on the surfaces of which suitable seats are provided for this purpose), while the interconnecting parts 17 and 18 are designed to be retained, respectively, inside the outer section 8A and inside the inner section 8B of the said slit—see FIGS. 5 and 6.

As shown in FIGS. 3 to 6, the inserts 11 and 12 extend in an interfering manner both over the outer and over the inner surface of the shell 1 and not over only the inner surface as in the case of the tongues according to the prior art described above. Moreover, both the flanges of the said inserts have, in a direction transverse with respect to the longitudinal centre plane of the boot, a width such as to cover not only all the corresponding sections 8A and 8B of the transverse slit, but also extend beyond the longitudinal separating line 5—see FIG. 3. All this ensures a perfect seal against the infiltration of water and snow inside the shell 1.

According to an important characteristic feature of the invention, each of the inserts 11 and 12 is manufactured as one piece from soft and resilient material by means of injection moulding.

In order to increase the reliability of the boot, the inserts 11 and 12 are fixed onto the shell 1, for example by means of rivets or other fixing devices (not shown) which pass through at least one of their flanges and which, in any case, may be removed if necessary.

The advantages offered by the invention may be summarized thus:

- the seal provided by the boot against snow and water is particularly good, without adversely affecting the ease of insertion of the foot and the adherence of the shell to the said foot;
- the inserts may be manufactured independently of the shell;
- the step of assembly of the inserts on the shell is in any case perfectly compatible with the boot production cycle;
- the inserts may be made using many types of polymer material, also totally different from those from which the shell is made of, there being none of the above mentioned drawbacks associated with the heat-welding processes. It is thus possible for the boot manufacturer to use for the said shell polypropylene which has favourable characteristics from a technical and cost-related point of view;
- when the bot is scrapped, at the end of its useful life, the inserts can be removed from the shell in an easy and low-cost manner through a treatment preceding an environmental friendly recycling of the raw materials.

What is claimed is:

1. Footwear having:

a shell (1) manufactured as one piece from polymer material and comprising a sole (2) and an upper part (3) which has, hinged on it, an outer leg-piece and which is provided, on the front of the boot, with a separating line (5) parallel to the longitudinal mid-plane and a slit which has two sections (8A, 8B) on the two sides of the said separating line (5) opposite the user's heel so that the said upper part (3) is divided into a first pair of flaps (6A, 7A) on the outer side of the shell (1) and into a second pair of flaps (6B, 7B) on the inner side of the shell;

sealing means (11, 12) applied to the shell (1) in the region of the said transverse slit;

characterized in that the said sealing means (11, 12) are removable inserts which comprise:

a pair of shaped flanges (13, 15; 14, 16) designed to interfere both with the outer surface and with the inner surface of the said pair of flaps (6A, 7A; 6B, 7B) on the two sides of the shell (1);

respective interconnecting parts (17, 18) designed to be retained by the two sections (8A, 8B) of the said transverse slit.

2. Footwear according to claim 1, characterized in that each of the said inserts (11, 12) is manufactured as one piece from soft and resilient polymer material by means of injection moulding.

3. Footwear according to claim 2, characterized in that the shell (1) and the inserts (11, 12) are manufactured using types of polymer material which are different from each other.

4. Footwear according to claim 2, characterized in that the shell (1) and the inserts (11, 12) are manufactured using the same types of polymer material.

5. Footwear according to claim 1, characterized in that the inserts (11,12) are fixed to the shell (1) by means of rivets or the releasable fixing means which pass through at least one of their flanges (13,14,15,16).

6. Footwear according to claim 1, characterized in that, in the region of the inserts (11,12), the inner surfaces and/or outer surfaces of the said pairs of flaps (6A,7A and 6B, 7B) of the said upper part (3) of the shell (1) have seats suitable for engagements with the said inserts (11,12).

* * * * *